US007848668B2

(12) United States Patent
Condello et al.

(10) Patent No.: US 7,848,668 B2
(45) Date of Patent: Dec. 7, 2010

(54) FUSERS, PRINTING APPARATUSES AND METHODS OF FUSING TONER ON MEDIA

(75) Inventors: Anthony S. Condello, Webster, NY (US); Eric Scott Hamby, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 66 days.

(21) Appl. No.: 12/262,540

(22) Filed: Oct. 31, 2008

(65) Prior Publication Data

US 2010/0111549 A1 May 6, 2010

(51) Int. Cl.
*G03G 15/00* (2006.01)

(52) U.S. Cl. ..... 399/45; 399/334; 399/336

(58) Field of Classification Search ..... 399/45, 399/67, 69, 70, 335–337, 334
See application file for complete search history.

(56) References Cited

U.S. PATENT DOCUMENTS 3,013,342 A 12/1961 Huber et al.
3,117,847 A 1/1964 Norton
3,792,488 A 2/1974 Katakabe
4,079,228 A 3/1978 Moser
4,538,899 A 9/1985 Landa et al.
5,014,090 A 5/1991 Santilli
5,140,377 A 8/1992 Lewis et al.
6,067,437 A * 5/2000 Schonfeld ..... 399/320
2008/0037069 A1 2/2008 Mestha et al.
2008/0095548 A1 * 4/2008 Iwaishi et al. ..... 399/45

FOREIGN PATENT DOCUMENTS

JP 2006-085059 * 3/2006

* cited by examiner

*Primary Examiner*—Hoang Ngo
(74) *Attorney, Agent, or Firm*—Prass LLP

(57) ABSTRACT

Fusers, printing apparatuses and methods of fusing toner on media are disclosed. An embodiment of a fuser for fusing toner on a medium includes at least two modules arranged along a process direction of the medium, each module having an ON state in which the module discharges a hot gas and an OFF state in which the module does not discharge the hot gas; and a controller connected to the modules for controlling the ON/OFF state of each module to control the discharge of the hot gas from each module onto the medium as the medium is transported past the modules in the process direction.

17 Claims, 6 Drawing Sheets

FUSERS, PRINTING APPARATUSES AND METHODS OF FUSING TONER ON MEDIA

BACKGROUND

In some printing apparatuses, toner images are formed on media and the media are then heated to fuse (fix) the toner onto the media. In such apparatuses, the toner can be fused onto media by applying pressure to the media and toner, such as with rolls, or without applying such pressure.

It would be desirable to provide apparatuses and methods for fusing toner on media without using applied pressure, which can enable consistent fusing for different types of media.

SUMMARY

Embodiments of fusers, printing apparatuses and methods of fusing toner on media are disclosed. An embodiment of a fuser for fusing toner on a medium comprises at least two modules arranged along a process direction of the fuser, each module having an ON state in which the module discharges a hot gas and an OFF state in which the module does not discharge the hot gas; and a controller connected to the modules for controlling the ON/OFF state of each module to control the discharge of the hot gas from each module onto the medium as the medium is transported past the modules in the process direction.

DRAWINGS

DETAILED DESCRIPTION

The disclosed embodiments include a fuser for fusing toner on a medium, which includes at least two modules arranged along a process direction of the fuser, each module having an ON state in which the module discharges a hot gas and an OFF state in which the module does not discharge the hot gas; and a controller connected to the modules for controlling the ON/OFF state of each module to control the discharge of the hot gas from each module onto the medium as the medium is transported past the modules in the process direction.

The disclosed embodiments further include a fuser for fusing toner on media, which comprises an array of modules comprising at least two modules arranged in a first row and at least two modules arranged in a second row adjacent the first row, the first and second rows extending in a cross-process direction perpendicular to a process direction of the fuser, each module having an ON state in which the module discharges a hot gas and an OFF state in which the module does not discharge the hot gas; and a controller connected to each module for controlling the ON/OFF state of each module to control the discharge of the hot gas from each module onto a medium transported past the modules in the process direction.

The disclosed embodiments further include a method of fusing toner on a medium in a fuser, comprising transporting a first medium carrying toner in a process direction of the fuser past at least two modules arranged along the process direction, each module having an ON state in which the module discharges a hot gas and an OFF state in which the module does not discharge the hot gas; and controlling the ON/OFF state of each module using a controller connected to the modules to discharge the hot gas from at least one of the modules onto the first medium as the first medium is transported in the process direction to fuse the toner onto the first medium.

Figure 1:
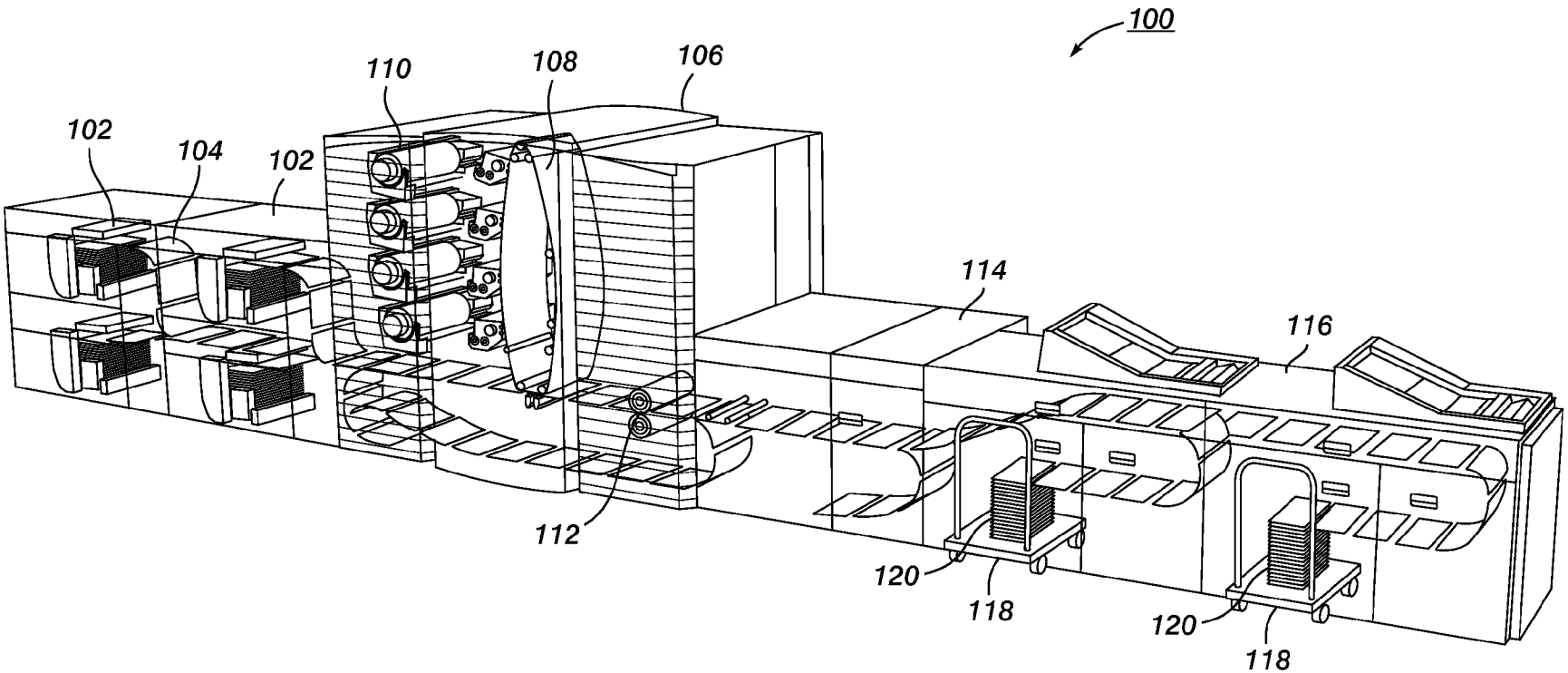
FIG. 1 illustrates an exemplary embodiment of a printing apparatus.

FIG. 1 illustrates an exemplary printing apparatus 100, such as disclosed in U.S. Patent Application Publication No. 2008/0037069, which is incorporated herein by reference in its entirety. As used herein, the term "sprinting apparatus" encompasses any apparatus, such as a digital copier, bookmaking machine, multifunction machine, and the like, that performs a print outputting function for any purpose. The printing apparatus 100 can be used to produce prints from various types of media at high speeds. In embodiments, the printing apparatus 100 has a modular construction. As shown, the apparatus includes two media feeder modules 102 arranged in series, a printer module 106 adjacent the media feeding modules 102, an inverter module 114 adjacent the printer module 106, and two stacker modules 116 arranged in series adjacent the inverter module 114.

In the printing apparatus 100, the media feeder modules 102 are adapted to feed media having various sizes (widths and lengths) and weights to the printer module 106. In the printer module 106, toner is transferred from a series of developer stations 110 to a charged photoreceptor belt 108 to form toner images on the photoreceptor belt and produce color prints. The toner images are transferred to one side of respective media 104 fed through the paper path. The media are advanced through a fuser 112 adapted to apply heat and pressure to the media to fuse toner images on the media. The application of direct physical pressure to fuse toner on media is referred to as contact printing. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

Embodiments of the disclosed fusers include at least two modules. The modules can be arranged, e.g., in series, or in arrays. The fuser modules produce a hot gas used to heat media and toner images on the media as the media move past the modules. The media can have various weights, and can be coated or uncoated. For example, the media can be paper, or packaging materials comprised of polymers, thin films and the like. The hot gas can be any suitable single gas, or a gas mixture of two or more gases, effective to provide sufficient thermal energy to heat the media and toner to a sufficiently-high temperature to fuse the toner onto the media. For example, the hot gas can be steam, or a mixture of steam and at least one other gas, such as a mixture of steam and hot air containing an effective amount of steam to fuse toner. The fusers are constructed to fuse toner on media without applying direct physical pressure to the media during the fusing, i.e., by "contact-less printing."

Figure 2:
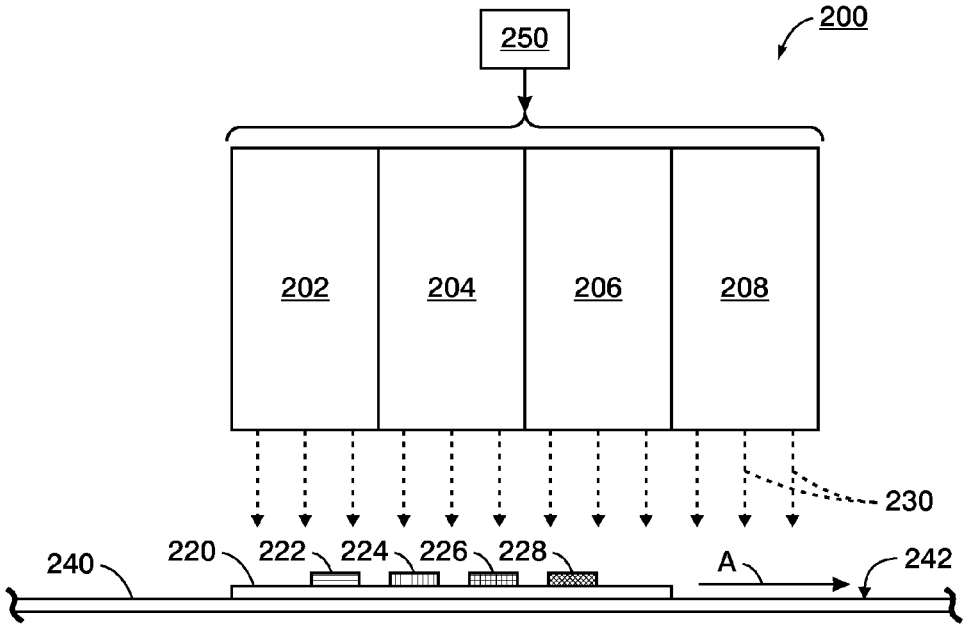
FIG. 2 illustrates an exemplary embodiment of a fuser including four modules arranged in series.

FIG. 2 illustrates an exemplary embodiment of a fuser 200. The fuser 200 can be used in various printing apparatuses. For example, the fuser 200 can be used in the printing apparatus 100 shown in FIG. 1 in place of the fuser 112.

The embodiment of the fuser 200 shown FIG. 2 includes four modules 202, 204, 206, 208 arranged in this order in series along the process direction A. Each module 202, 204, 206, 208 has an "ON" state in which the module discharges a hot gas, and an "OFF" state in which the module does not discharge the hot gas. The fuser 200 includes a controller 250 connected to the modules 202, 204, 206, 208 to control their ON/OFF states based on at least one characteristic of a medium fused by the fuser 200. Each module 202, 204, 206, 208 can be set to the ON state to apply hot gas to media carrying toner images as the media move past these modules in order to heat the media and toner to at least the toner fusing temperature. When the hot gas contains steam, for example, the media and toner are heated by the release of thermal energy resulting from condensation of the steam. The modules 202, 204, 206, 208 can typically be spaced from the medium 220 by a distance of about 2 mm to about 20 mm.

The respective modules 202, 204, 206, 208 can each include a perforated plate (not shown) facing the transport device 240. For example, the perforated plates can include uniformly spaced holes through which steam is discharged. In other embodiments, the modules 202, 204, 206, 208 can include one or more slots through which hot gas is discharged. The slots can extend in the process direction A, the cross-process direction perpendicular to the process direction, or at an acute angle with respect to the process direction A.

As used herein, a "module" is a unit that has the capacity to fuse toner on media using hot gas heating at some "productivity." In embodiments of the disclosed fusers, the productivity of an individual module can be quantified based on the maximum number of pages per minute (ppm) that the module has the capacity to fuse by heating with the discharged hot gas. The productivity of the modules can be quantified based, e.g., on the type of media that is most stressful for the modules to fuse toner on by heating the media with hot gas. Typically, the most-stressful type of media is heavy-weight, coated paper. The maximum number of pages per minute that one of the modules can fuse toner on by using hot gas heating is higher for less-stressful types of media than for such heavy-weight, coated paper. The maximum number of pages per minute that one of the modules can fuse toner on by hot gas heating increases with decreasing media weight, and is higher for uncoated media as compared to coated media.

In the fuser 200, each module 202, 204, 206, 208 has an individual productivity. The group of modules 202, 204, 206, 208 has a total productivity equal to about the sum of the productivities of the four individual modules 202, 204, 206, 208.

FIG. 2 shows a medium 220 with toner images 222, 224, 226, 228 supported on a surface 242 of a transport device 240. The medium 220 is transported past the modules 202, 204, 206, 208 in the process direction A. The transport device 240 can be a belt. In other embodiments, the transport device can be a roll, or the like. In embodiments, the modules 202, 204, 206, 208 are constructed to be able to discharge hot gas over a portion of, or over substantially the entire surface of, the medium 220 on which the toner images are formed. When the medium 220 is transported at a constant speed by the transport device 240, each toner image 222, 224, 226, 228 is exposed to hot gas 230, such as steam or a steam mixture, discharged by the modules 202, 204, 206, 208 for about the same total amount of time. In embodiments, the fuser 200 can include optional vertically-extending dividers (not shown) extending downwardly from the modules toward the transport device 240 to separate adjacent ones of the modules from each other (e.g., modules 202, 204; 204, 206 and 206, 208) in order to localize and reduce cooling of the hot gas discharged by adjacent modules.

In embodiments of the fuser 200, each of the modules 202, 204, 206, 208 can have the same productivity. In such embodiments, the modules can interchanged with each other in the fuser 200. For example, each module 202, 204, 206, 208 can have a productivity of about 20 ppm, 30 ppm (which corresponds to a process speed of about 140 mm/sec in process direction A), about 40 ppm, about 50 ppm, or about 60 ppm. In embodiments, modules of the fuser having the same productivity can have the same physical dimensions, including length in the process direction A. When each module 202, 204, 206, 208 has the same productivity of, e.g., about 30 ppm, and is turned ON to discharge hot gas, the productivity of fuser 200 is about 120 ppm.

In embodiments, increasing the length of a module linearly increases the module's productivity by increasing the amount of time that a medium is exposed to a hot gas that heats the medium moving past the module. For example, a module with a productivity of about 60 ppm can be about twice as long in the process direction A as a module that provides a productivity of about 30 ppm. When a medium is transported at the same process speed in a first fuser including the module with a productivity of about 60 ppm, and in a second fuser including the module with a productivity of about 30 ppm, the medium will be exposed to hot gas for about twice as long in the first fuser than in the second fuser.

In other embodiments of the fuser 200, at least one of the modules 202, 204, 206, 208 can have a different productivity than the other modules. For example, modules 202, 204 can each have a productivity of about 30 ppm, and modules 206, 208 can each have a productivity of about 60 ppm. In such embodiments, the productivity of the fuser 200 is about 180 ppm when each of the modules 202, 204, 206, 208 is turned ON.

In embodiments of the fuser 200, toner can be fused on different types of media by turning selected ones of the modules 202, 204, 206, 208 ON or OFF in a digital manner. The media can be light-weight, medium-weight, or heavy-weight, and can be coated or uncoated. Regarding paper media, weights are typically classified as follows: light-weight: ≦about 75 gsm, medium-weight: about 75 gsm to about 160 gsm, and heavy-weight: ≧160 gsm. Typically, these different weights of paper have the following approximate fusing temperatures: light-weight: about 180° C., medium-weight: about 190° C., and heavy-weight: about 200° C. For a given weight of paper, coated paper typically has a fusing temperature about 10° C. higher than that of uncoated paper. Transparencies can typically have a fusing temperature of about 200° C. Each module 202, 204, 206, 208 can be turned ON to apply hot gas to media carrying toner images to heat the media and toner to at least the toner fusing temperature for a sufficient amount of time to fuse the toner onto the media.

TABLE 1 shows exemplary module status (ON/OFF) sequences for fusing toner on light-weight coated ("LW-C"), medium-weight coated ("MW-C") and heavy-weight coated ("HW-C") paper using fuser 200. The sequences can be predefined based on testing results for these types of media. In this example, each module 202, 204, 206, 208 has a productivity of about 30 ppm based on the heavy-weight coated paper, and the maximum productivity of the fuser for the heavy-weight coated paper is 120 ppm.

TABLE 1

| Media Type | Module No./Status | | | |
|---|---|---|---|---|
| LW-C | 202/ON | 204/ON | 206/OFF | 208/OFF |
| MW-C | 202/ON | 204/ON | 206/ON | 208/OFF |
| HW-C | 202/ON | 204/ON | 206/ON | 208/ON |

For fusing light-weight coated paper, with modules 202, 204 turned ON, and modules 206, 208 turned OFF, the productivity of each module 202, 204 is 60 ppm. For fusing medium-weight coated paper, with modules 202, 204, 206 turned ON, and module 208 turned OFF, the productivity of each module 202, 204, 206 is 40 ppm.

This example demonstrates that embodiments of the fuser 200 can be used to fuse different types of media at the same process speed and without transitional time delay. The use of stackable modules and the capability to individually turn the modules ON and OFF enables immediate media switching and uninterrupted mixed-media jobs. In other embodiments, the process speed used to fuse toner on a given type of media can be varied by turning a different number of the modules ON. For example, to fuser toner on light-weight coated media at a productivity of 240 ppm using fuser 200, each of the modules 202, 204, 206, 208 can be turned ON.

This example also demonstrates that when each module 202, 204, 206, 208 provides the same productivity and energy output, the fuser 200 consumes 25% less total energy to fuse toner on medium-weight coated paper, and 50% less total energy to fuse toner on light-weight coated paper, as compared to heavy-weight coated paper, by sequencing the modules as shown in TABLE 1.

Typically, less energy needs to be applied by the fuser modules to fuse toner on uncoated media than on coated media. For example, in the fuser 200, to fuse toner on uncoated, heavy-weight media, module 208 can be turned OFF.

In embodiments of the fuser 200, it is more energy efficient to fuse toner on media with adjacent modules turned ON to continuously supply energy to the media as they move past the adjacent modules. For example, toner can be fused on light-weight coated media with modules 202, 204 turned ON and modules 206, 208 turned OFF as shown in TABLE 1, or alternatively with modules 204, 206 turned ON and modules 202, 208 turned OFF, or with modules 202, 204 turned OFF and modules 206, 208 turned ON. Toner can be fused on medium-weight coated media alternatively with module 202 turned OFF and modules 204, 206, 208 turned ON.

In other embodiments of the fuser 200, the amount of energy supplied to media by the modules 202, 204, 206, 208 of the fuser 200 can be controlled by using a staggered ON/OFF sequence of these modules to control heating of the media. For example, a medium can be over-fused when a fuser supplies an amount of energy to the medium that exceeds the amount of energy sufficient to produce the desired level of fusing for the medium. If, for example, a medium-weight coated medium is slightly over-fused when consecutively-arranged modules 202, 204, 206 are turned ON and module 208 is turned OFF, this ON/OFF sequence can be changed to have modules 202, 204, 208 turned ON, with module 206 turned OFF. By turning module 206 OFF between modules 204, 208, there will be some loss of thermal energy in the fuser 200 as manifested by a smaller increase in temperature of the medium. Consequently, staggering the ON/OFF sequence of the modules in this manner can result in less total thermal energy being applied to subsequently-processed, medium-weight coated media in the fuser 200 to avoid such over-fusing.

As used herein, the term "dwell" means the total amount of time that a medium is exposed to hot gas discharged by the modules of a fuser as the medium is transported past the modules. In the fuser 200, when all modules 202, 204, 206, 208 are turned ON for fusing heavy-weight media, and each of these modules has a length, L, in the process direction A, and each module discharges hot gas along its entire length, when the medium 240 is transported past the modules 202, 204, 206, 208 at a process speed, S, the dwell, D, equals 4L/S. This dwell will be the same for each heavy-weight coated medium fused using this sequence. When modules 202, 204, 206 are turned ON and module 208 is turned OFF for fusing medium-weight coated media, the dwell D equals 3L/S. When modules 202, 204 are turned ON and modules 206, 208 are turned OFF for fusing light-weight coated media, the dwell D equals 2L/S.

Figure 3:
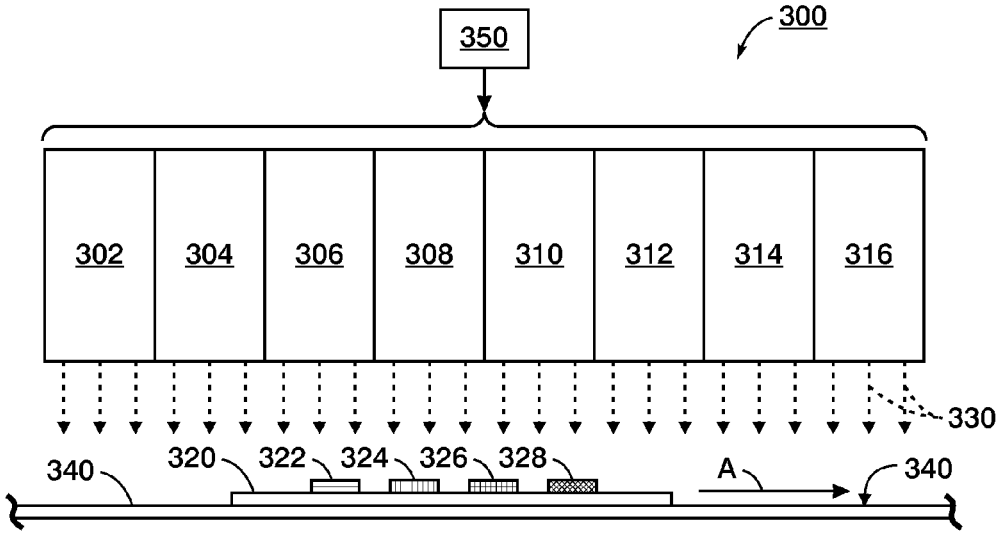
FIG. 3 illustrates another exemplary embodiment of a fuser including eight modules arranged in series

Embodiments of the fusers including modules can fuse toner on coated or uncoated media of different types at about the same dwell for different fuser productivities. FIG. 3 shows a fuser 300 according to another exemplary embodiment. The fuser 300 includes eight modules 302, 304, 306, 308, 310, 312, 314, 316 arranged in this order in series along the process direction A. These modules can have the same construction as the modules of fuser 200, for example. The fuser 300 includes a controller 350 connected to the modules 302, 304, 306, 308, 310, 312, 314, 316 to control their respective ON/OFF state based on at least one characteristic of a medium fused by the fuser 300. In the fuser 300, each module 302, 304, 306, 308, 310, 312, 314, 316 has an individual productivity. This group of modules has a total productivity equal to about the sum of the productivities of the individual modules 302, 304, 306, 308, 310, 312, 314, 316.

FIG. 3 shows a medium 320 with toner images 322, 324, 326, 328 supported on a surface 342 of a transport device 340. The medium 320 is transported past the modules 302, 304, 306, 308, 310, 312, 314, 316 in the process direction A. When the medium 320 is transported at a constant speed by the transport device 340, each toner image 322, 324, 326, 328 is exposed to hot gas 330 discharged by the modules 302, 304, 306, 308, 310, 312, 314, 316 for about the same total amount of time. In embodiments, the fuser 300 can include optional vertically-extending dividers (not shown) extending downwardly from the modules toward the transport device 340 to separate adjacent ones of the modules from each other (e.g., modules 302, 304) in order to localize and reduce cooling of the hot gas discharged by adjacent modules.

In embodiments of the fuser 300, each of the modules 302, 304, 306, 308, 310, 312, 314, 316 can have the same productivity (and physical size), allowing the modules to be interchanged with each other in the fuser 300. For example, each module 302, 304, 306, 308, 310, 312, 314, 316 can have a productivity of about 30 ppm, about 40 ppm, about 50 ppm, or about 60 ppm. In embodiments of the fuser 300, when each module 302, 304, 306, 308, 310, 312, 314, 316 has the same productivity of about 30 ppm, and is turned ON to discharge hot gas, the productivity of fuser 300 is about 240 ppm.

In embodiments of the fuser 300, toner can be fused on different types of media by turning selected ones of the modules 302, 304, 306, 308, 310, 312, 314, 316 ON or OFF in a digital manner. The media can be light-weight, medium-weight, or heavy-weight, and can be coated or uncoated.

TABLE 2 shows exemplary module status sequences for fusing toner on media having different weight and coating characteristics. The media include light-weight uncoated ("LW-UC"), light-weight coated ("LW-C"), medium-weight uncoated ("MW-UC"), medium-weight coated ("MW-C"), heavy-weight uncoated ("HW-UC") and heavy-weight coated ("HW-C") paper using fuser 300. The sequences can be pre-defined based on testing results for these types of media. In this example, each of the modules 302, 304, 306, 308, 310, 312, 314, 316 has a productivity of about 30 ppm based on the heavy-weight paper, and the maximum productivity of the fuser for the heavy-weight paper is 240 ppm.

TABLE 2

| Media Type | Module No./Status | | | | | | | |
|---|---|---|---|---|---|---|---|---|
| LW-UC | 302/ON | 304/ON | 306/ON | 308/OFF | 310/OFF | 312/OFF | 314/OFF | 316/OFF |
| LW-C | 302/ON | 302/ON | 306/ON | 308/ON | 310/OFF | 312/OFF | 314/OFF | 316/OFF |
| MW-UC | 302/ON | 304/ON | 306/ON | 308/ON | 310/ON | 312/OFF | 314/OFF | 316/OFF |
| MW-C | 302/ON | 304/ON | 306/ON | 308/ON | 310/ON | 312/ON | 314/OFF | 316/OFF |
| HW-UC | 302/ON | 304/ON | 306/ON | 308/ON | 310/ON | 312/ON | 314/ON | 316/OFF |
| HW-C | 302/ON | 304/ON | 306/ON | 308/ON | 310/ON | 312/ON | 314/ON | 316/ON |

The dwell for the eight-module fuser 300 can be approximately equal to the dwell for the four-module fuser 200 when the same type of media is fused using these respective fusers 200 and 300. For example, when fusers 200, 300 are both used to fuse toner on light-weight coated media, two modules are turned ON in fuser 200, while four modules are turned ON in fuser 300. Accordingly, when light-weight coated media is transported at twice the process speed in fuser 300 as in fuser 200 (i.e., 240 ppm versus 120 ppm), the media is exposed to hot gas heating for about the same total amount of time in both fusers. As another example, when fusers 200, 300 are both used to fuse heavy-weight coated media, all four modules are turned ON in fuser 200, while all eight modules are turned ON in fuser 300. Accordingly, when heavy-weight coated media is transported at twice the process speed in fuser 300 as in fuser 200, the media is exposed to hot gas heating for about the same total amount of time in both fusers. Accordingly, the same type of media can be subjected to hot gas for about the same total amount of time for the four-module fuser 200 and eight-module fuser 300, while the productivity of fuser 300 is higher due to having additional modules.

This example further demonstrates that embodiments of the fuser 300 can be used to fuse different types of media at the same process speed and without transitional time delay. Increasing the number of modules in the fuser 300 coupled with the capability to individually turn the modules ON and OFF, enables immediate media switching and uninterrupted mixed-media jobs, as well as increased sequencing flexibility.

In embodiments of the fuser 300, it is more energy efficient to fuse toner on media with adjacent modules turned ON to continuously supply energy to the media as they move past the adjacent modules. For example, toner can be fused on light-weight coated media with any four consecutive ones of the modules turned ON and the remaining modules turned OFF (e.g., modules 302, 304, 306, 308 turned ON and modules 310, 312, 314, 316 turned OFF; or modules 302, 304, 314, 314 turned OFF and modules 306, 308, 310, 312 turned ON). As another example, toner can be fused on medium-weight coated media with any six consecutive ones of the modules turn ON and the remaining two modules of fuser 300 turned OFF.

In other embodiments of the fuser 300, the amount of energy supplied to media by the modules 302, 304, 306, 308, 310, 312, 314, 316 can be controlled by using a staggered ON/OFF sequence of these modules to control heating of the media. For example, when it is desirable to use less energy to fuse toner on a first medium (e.g., a light-weight coated medium) than a second medium of the same type, staggered modules 302, 306, 310, 314, or staggered modules 302, 304, 314, 316 can be used for fusing the first medium, while consecutively-arranged modules 302, 304, 306, 308 can be used for the second medium.

Accordingly, embodiments of the fusers, such as fusers 200 and 300 can be used to fuse toner on media having different properties (e.g., weights and coatings) and image characteristics (e.g., % area coverage, TMA, desired quality). The fuser modules can be controlled using a pre-defined ON/OFF sequence to provide more or less fusing, as appropriate, to optimize results for such media. In the fusers, a variable number of modules combined with individual module activation/deactivation enable customization of fusing-related factors including productivity, media weight, media coating, fix level, gloss level and/or addressable gloss level.

Figure 4:
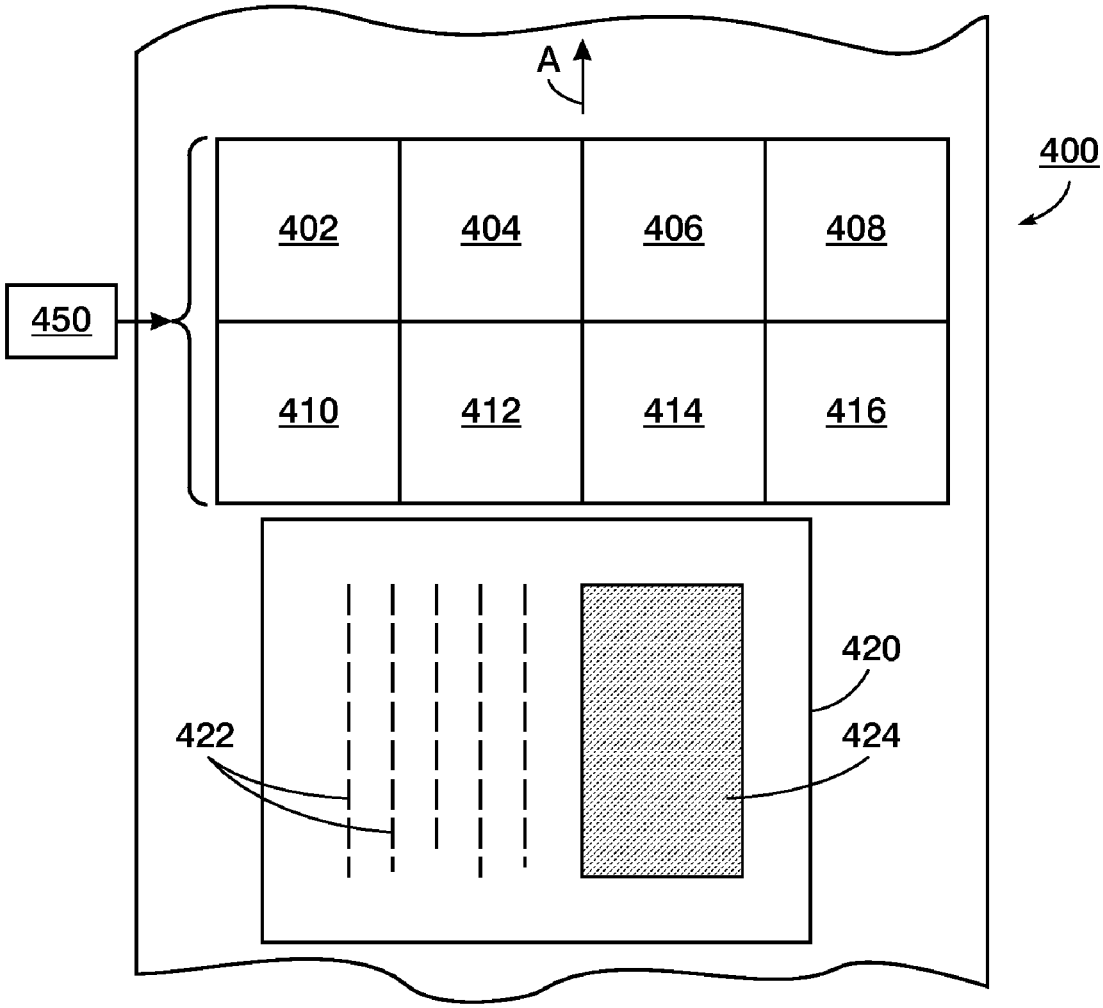
FIG. 4 illustrates an exemplary embodiment of a fuser including modules arranged in an array.

FIG. 4 shows a fuser 400 according to another exemplary embodiment. The fuser 400 includes eight modules 402, 404, 406, 408, 410, 412, 414 and 416 arranged in a 2×4 matrix array, with modules 402, 404, 406, 408 in a first row and modules 410, 412, 414, 416 in a second row. The fuser 400 includes a controller 450 connected to the modules 402, 404, 406, 408, 410, 412, 414, 416 to control their respective ON/OFF state. These modules can have the same construction as the modules of fuser 200, for example. The module arrangement shown in FIG. 4 allows quasi-addressable fusing within a page, as well as page-to-page. Other embodiments of the fuser can include a matrix array with a different number of modules, such as a 2×2, or a 2×3 array. In embodiments, the fuser can provide addressability in the cross-process direction for commonly-used media widths, such as paper widths of 8.5 inch, 11 inch and 14 inch. In embodiments, each module 402, 404, 406, 408, 410, 412, 414 and 416 can have the same productivity, e.g., 30 ppm based on heavy-weight coated paper.

In FIG. 4, a medium 420 is shown being fed to the fuser 400 in the process direction A. The medium 420 includes both text images 422 and graphic images 424 at different regions of a surface of the medium 420. By selectively turning ON and OFF the modules, 402, 404, 406, 408, 410, 412, 414 and 416 of the array, the gloss of these images can be varied in the cross-process direction (i.e., perpendicular to process direction A) so that the text images 422 receive, e.g., a matte finish while the graphic images 424 receive, e.g., a glossy finish. As text images can be fused with less applied energy than graphic images, the following exemplary module ON/OFF sequence can be used to control gloss in the cross-process direction for medium 420: module 402/ON, module 404/ON, module 406/ON, module 408/ON, module 410/OFF, module 412/OFF, module 414/ON, module 416/ON. For another medium including text images and graphic images at locations on a surface of the medium reversed from that of the medium 420, the following exemplary module ON/OFF sequence can be used to control gloss in the cross-process direction for medium 420: module 402/ON, module 404/ON, module 406/ON, module 408/ON, module 410/ON, module 412/ON, module 414/OFF, module 416/OFF.

In other embodiments, the fuser 400 can be used to address the gloss of text images and/or graphic images on media, such as medium 420, in the process direction A.

Figure 5:
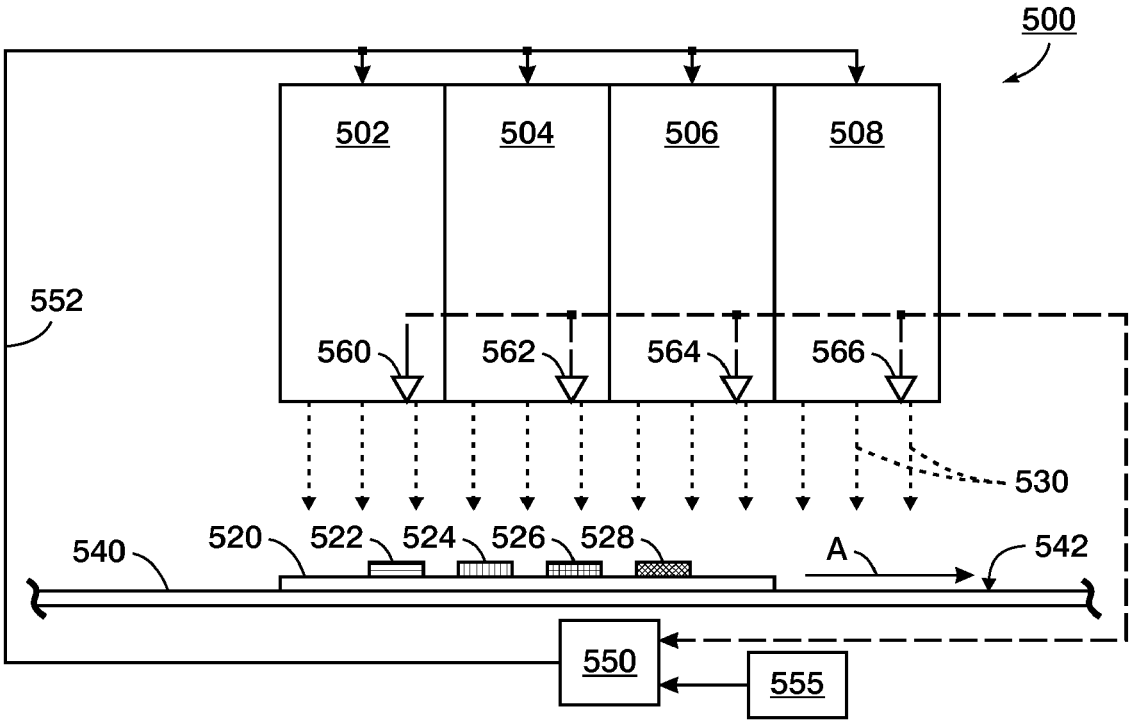
FIG. 5 illustrates an exemplary embodiment of a fuser including modules arranged in series with feedback control.

FIG. 5 shows a fuser 500 according to another exemplary embodiment. The fuser 500 includes four modules 502, 504, 506 and 508. These modules can have the same construction as the modules of fuser 200, for example. Other embodiments of fuser 500 can include two, three or more than four modules. A medium 520 carrying toner images 522, 524, 526, 528 is shown on a surface 542 of a transport device 540. The medium 520 is transported past the modules 502, 504, 506, 508 in the process direction A. The modules 502, 504, 506 and 508 are controlled automatically via feedback. The fuser 500 further includes a controller 550 connected to the modules 502, 504, 506, 508 to send ON/OFF signals to these modules. At least one sensor 560, 562, 564, 566 is operatively associated with each respective module 502, 504, 506, 508. The sensors 560, 562, 564, 566 sense a process condition, e.g., local hot gas temperature of each respective module 502, 504, 506, 508, or a media characteristic, e.g., image gloss, as the medium 540 passes each module 502, 504, 506, 508. In embodiments, the hot gas temperature is typically not controlled for the modules 502, 504, 506, 508. The sensors 560, 562, 564, 566 send output signals to the controller 550.

Target values 555 are input to the controller 550. The target values are desired outputs for the modules 502, 504, 506, 508. For example, the target values can be hot gas temperature or gloss values. A typical temperature target value is about 110° for the modules. Target gloss values can typically be about 10 to about 90 Gardner gloss units (ggu), such as about 40 to about 80 ggu, depending on the media type being fused. The image gloss can be matched to the media gloss. The temperature and gloss value outputs from the modules 502, 504, 506, 508 are controlled by turning these modules ON and OFF with the controller 550 using feedback control when these outputs vary from the target values.

In embodiments, the modules 502, 504, 506 and 508 can be automatically controlled based on user preferences to provide desired media image characteristics. For example, if a predefined sequence of these modules begins to fail to achieve a desired media appearance due to a disturbance to the printing apparatus or printing process (e.g., an environmental change, apparatus aging and/or a change in media type), then feedback control can be used to turn ON one or more additional modules to re-establish the desired document appearance.

Figure 6:
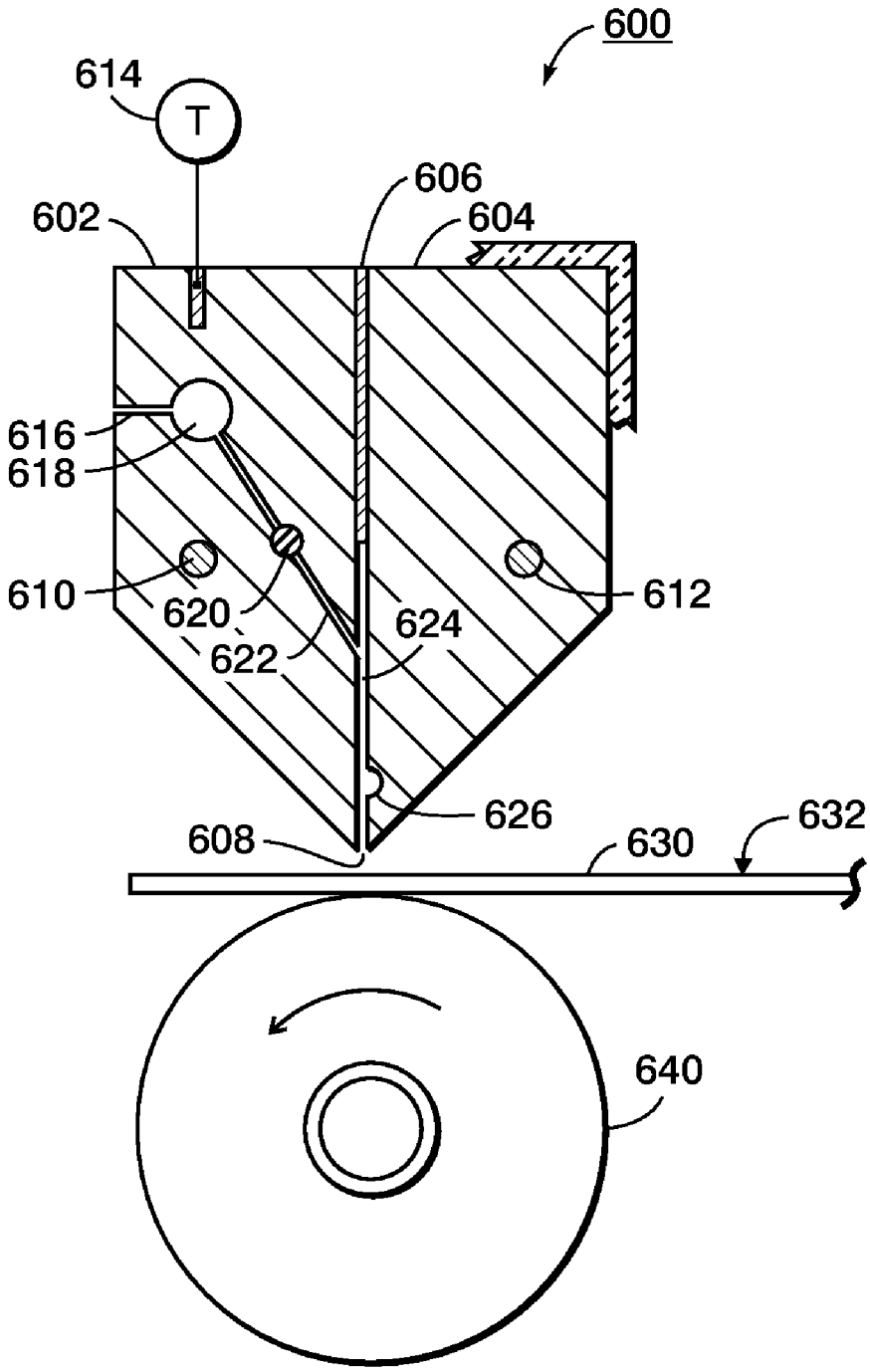
FIG. 6 illustrates an exemplary embodiment of a device for fusing toner on media.

FIG. 6 depicts an exemplary embodiment of a device 600 for fusing toner on media, such as disclosed in U.S. Pat. No. 5,140,377, which is incorporated herein by reference in its entirety. The device 600 can be used as a module in embodiments of the fusers 200, 300, 400, 500. The device 600 includes metal blocks 602, 604 separated by a shim 606 to define a slit 608 at one end. Heating elements 610, 612 are provided to heat the blocks 602, 604, respectively. The device 600 further includes a temperature monitoring device 614. Liquid water is introduced into the device 600 via an input channel 616. The input channel 616 communicates with a buffer cavity 618 and an output channel 622. In the buffer cavity 618, the liquid water is heated to a sufficiently-high temperature to cause boiling of the water. A throttle 620 is provided along the output channel 622 to control discharge of the water vapor in the buffer cavity 618 through the output channel 622. The water vapor enters a gap 624 and is discharged from the device 600 through the slit 608. A cross-channel 624 equalizes output pressure.

As shown in FIG. 6, a medium 630 having a surface 632 facing the slit 608 is transported past the device 600 by a transport device 630. Steam is discharged via the slit 608 onto the surface 632 carrying toner. Heat is released to the medium 630 to heat toner on the surface 632 to a sufficiently-high temperature to fuse the toner onto the surface 632.

Figure 7:
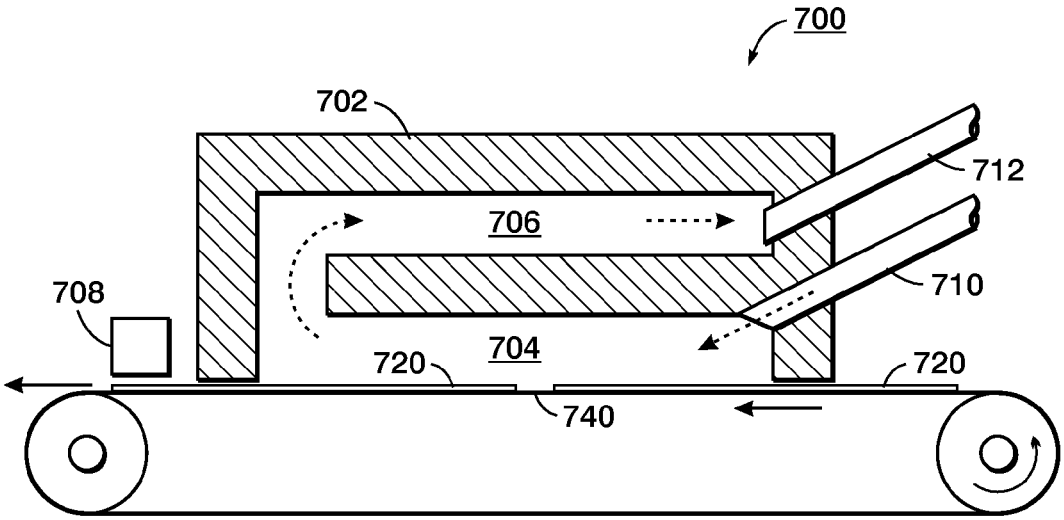
FIG. 7 illustrates another exemplary embodiment of a device for fusing toner on media.

FIG. 7 depicts an exemplary embodiment of a device 700 for fusing toner on media. The device 700 can be similar to devices disclosed in U.S. Pat. No. 6,067,437. The device 700 can be used as a module in embodiments of the fusers 200, 300, 400, 500. As shown, the device 700 includes a housing 702 defining spaces 702, 704. A gas inlet line 710 communicates with space 704, and a gas outlet line 712 communicates with space 706. Two paper sheets 720 are shown transported on a transport belt 740. The device 700 also includes a cooling device 708 for cooling the paper sheets 720 and toner.

Embodiments of the fusers 300, 400, 500 can also be used in various printing apparatuses. For example, these fusers can be used in the printing apparatus 100 shown in FIG. 1 in place of the fuser 112.

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A fuser for fusing toner on a medium, comprising:

at least two modules arranged along a process direction of the fuser, each module having an ON state in which the module discharges a hot gas away from the module and an OFF state in which the module does not discharge the hot gas; and a controller connected to the modules for controlling the ON/OFF state of each module to control the discharge of the hot gas away from each module onto the medium as the medium is transported past the modules in the process direction;

wherein at least one sensor is operatively associated with each respective module, each sensor being connected to the controller and adapted to sense a process condition or a characteristic of the medium as the medium is transported past the respective module; and target values of the process condition or characteristic of the medium are input to the controller, each of the sensors sends an output signal to the controller based on the sensed process condition or characteristic of the medium, and the controller controls the ON/OFF state of each module using feedback control based on the sensed process condition or characteristic of the medium.

2. The fuser of claim 1, further comprising a transport device for transporting the medium in the process direction past the modules.

3. The fuser of claim 1, wherein:

each module is adjacent at least one other module;

each module has the same productivity; and each module discharges the hot gas along the same process length in the process direction.

4. The fuser of claim 1, comprising at least four modules arranged in series along the process direction.

5. A printing apparatus comprising a fuser according to claim 1.

6. The fuser of claim 1, wherein the hot gas comprises steam.

7. A fuser for fusing toner on a medium, comprising:

an array of modules comprising at least two modules arranged in a first row and at least two modules arranged in a second row adjacent the first row, the first and second rows extending in a cross-process direction perpendicular to a process direction of the fuser, each module having an ON state in which the module discharges a hot gas away from the module and an OFF state in which the module does not discharge the hot gas; and a controller connected to each module for controlling the ON/OFF state of each module to control the discharge of the hot gas away from each module onto the medium as the medium is transported in the process direction;

wherein at least one sensor is operatively associated with each respective module, each sensor being connected to the controller and adapted to sense a process condition or a characteristic of the medium as the medium is transported past the respective module; and target values of the process condition or characteristic of the medium are input to the controller, each of the sensors sends an output signal to the controller based on the sensed process condition or characteristic of the medium, and the controller controls the ON/OFF state of each module using feedback control based on the sensed process condition or characteristic of the medium.

8. The fuser of claim 7, further comprising a transport device for transporting the medium in the process direction past the modules of the first and second rows.

9. The fuser of claim 7, wherein:

each module is adjacent at least two other modules;

each module has the same productivity; and each module discharges the hot gas along the same process length in the process direction.

10. The fuser of claim 7, wherein each module of the first row is adjacent a module of the first row and a module of second row.

11. A printing apparatus comprising a fuser according to claim 7.

12. A method of fusing toner on a medium in a fuser, comprising:

transporting a first medium carrying toner in a process direction of the fuser past at least two modules arranged along the process direction, each module having an ON state in which the module discharges a hot gas away from the module and an OFF state in which the module does not discharge the hot gas;

sensing a process condition or a characteristic of the first medium with sensors operatively associated with each module as the first medium is transported past the modules;

inputting target values of the process condition or characteristic of the first medium to a controller;

sending an output signal from each sensor to the controller based on the sensed process condition or characteristic of the first medium; and controlling the ON/OFF state of each module using a controller connected to the modules using feedback control based on the sensed process condition or characteristic of the first medium to discharge the hot gas away from at least one of the modules onto the first medium as the first medium is transported in the process direction to fuse the toner onto the first medium.

13. The method of claim 12, wherein:

the fuser comprises an array of modules comprising at least two modules arranged in a first row and at least two modules arranged in a second row adjacent to the first row, and the first and second rows extend in a cross-process direction perpendicular to a process direction of the fuser; and the ON/OFF state of each module is controlled using the controller to control the gloss of the first medium in the cross-process direction.

14. The method of claim 12, wherein:

the fuser comprises an array of modules comprising at least two modules arranged in a first row and at least two modules arranged in a second row adjacent to the first row, and the first and second rows extend in a cross-process direction perpendicular to a process direction of the fuser; and the ON/OFF state of each module is controlled using the controller to control the gloss of the first medium in the process direction.

15. The method of claim 12, further comprising:

transporting a second medium carrying toner in the process direction of the fuser past the modules; and controlling the ON/OFF state of each module using the controller to discharge the hot gas away from a second number of the modules onto the second medium to fuse the toner onto the second medium, the second number of modules being different from a first number of the modules from which the hot gas is discharged onto the first medium;

wherein the second medium has a different weight or a different coating characteristic than the first medium, and the first and second mediums are transported in the process direction at the same process speed.

16. The method of claim 12, further comprising:

transporting a second medium carrying toner in the process direction of the fuser past the modules; and controlling the ON/OFF state of each module using the controller to discharge the hot gas away from a second number of the modules onto the second medium to fuse the toner onto the second medium, the second number of modules being different from a first number of the modules from which the hot gas is discharged onto the first medium, to fuse the toner onto the second medium;

wherein the second medium has a different weight or a different coating characteristic than the first medium, and the first and second mediums are transported in the process direction at different process speeds.

17. The method of claim 12, wherein the hot gas comprises steam.

* * * * *